US010144219B2

(12) United States Patent
Seki et al.

(10) Patent No.: US 10,144,219 B2
(45) Date of Patent: Dec. 4, 2018

(54) LIQUID DISCHARGE HEAD

(71) Applicant: CANON KABUSHIKI KAISHA, Tokyo (JP)

(72) Inventors: Sayaka Seki, Tokyo (JP); Yuichiro Akama, Tokyo (JP); Yuji Tamaru, Yokohama (JP); Naoko Tsujiuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/497,496

(22) Filed: Apr. 26, 2017

(65) Prior Publication Data

US 2017/0334202 A1 Nov. 23, 2017

(30) Foreign Application Priority Data

May 20, 2016 (JP) ..... 2016-101230

(51) Int. Cl.

| | |
|---|---|
| ***B41J 2/145*** | (2006.01) |
| ***B41J 2/21*** | (2006.01) |
| ***B41J 2/15*** | (2006.01) |
| ***B41J 19/14*** | (2006.01) |

(52) U.S. Cl.

CPC ..... *B41J 2/145* (2013.01); *B41J 2/15* (2013.01); *B41J 2/21* (2013.01); *B41J 2/2125* (2013.01); *B41J 19/147* (2013.01)

(58) Field of Classification Search

CPC ..... B41J 2/2125; B41J 2/21; B41J 2/2121

See application file for complete search history.

(56) References Cited

U.S. PATENT DOCUMENTS

| | | | |
|---|---|---|---|
| 6,637,874 B2 | 10/2003 | Yazawa et al. | |
| 8,231,203 B2 | 7/2012 | Akama et al. | |
| 2017/0036465 A1* | 2/2017 | Suzuki | B41J 25/001 |

FOREIGN PATENT DOCUMENTS

JP 2010-076394 A 4/2010

* cited by examiner

*Primary Examiner* — Shelby Fidler

(74) *Attorney, Agent, or Firm* — Fitzpatrick, Cella, Harper & Scinto

(57) ABSTRACT

In a liquid discharge head, a third discharge port array group C1 which discharges a liquid of cyan, a second discharge port array group M1 which discharges a liquid of magenta, a fourth discharge port array group G which discharges a liquid of gray, a first discharge port array group Y which discharges a liquid of yellow, a second discharge port array group M2 which discharges a liquid of magenta, a third discharge port array group C2 which discharges a liquid of cyan are arranged in this order, in a direction. Each of discharge port arrays of the fourth discharge port array group G is formed of a plurality of discharge ports having a diameter smaller than that of a plurality of discharge ports which constitute first discharge port arrays of the second and third discharge port array groups C1, C2, M1 and M2.

8 Claims, 5 Drawing Sheets

LIQUID DISCHARGE HEAD

BACKGROUND OF THE INVENTION

Field of the Invention

The present invention relates to a liquid discharge head for discharging a liquid from a discharge port.

Description of the Related Art

As for a liquid discharge head for discharging a liquid such as an ink from a discharge port, a serial type of liquid discharge head is known which discharges a liquid to form an image while reciprocating with respect to a recording medium. In such a serial type of liquid discharge head, various proposals have been made regarding the arrangement of the discharge port array and sizes of discharge ports that constitute the discharge port array, in order to achieve the formation of a high-definition and high-quality image. Japanese Patent Application Laid-Open No. 2010-76394 discloses a structure for reducing the occurrence of color unevenness at the time when an image is recorded both in a forward direction and in a backward direction, and the occurrence of such a so-called "color transition" that a color of which the tint deviates from an ideal hue results in developing due to superposition of colors.

FIG. 10 is a schematic plan view of a recording element substrate in a liquid discharge head that has the structure described in Japanese Patent Application Laid-Open No. 2010-76394.

Referring to FIG. 10, in the recording element substrate 110, there are provided: two cyan discharge port array groups C1 and C2 which discharge a cyan ink; two magenta discharge port array groups M1 and M2 which discharge a magenta ink; and a yellow discharge port array group Y which discharges a yellow ink. The discharge port array groups are arranged in the order of the cyan discharge port array group C1, the magenta discharge port array group M1, the yellow discharge port array group Y, the magenta discharge port array group M2 and the cyan discharge port array group C2, in a main scanning direction A. Thereby, in a case where images are recorded both in the forward direction and in the backward direction in the main scanning direction A, the order of the ejection (discharge order) of the inks in each direction becomes the same, and the occurrence of the color unevenness due to a difference in the discharge order can be reduced.

Furthermore, in the recording element substrate 110, there are provided two gray discharge port array groups G1 and G2 that discharge a gray ink. For this reason, it is unnecessary to superpose the cyan, magenta and yellow inks so as to express gray, which is an intermediate color. As a result, the occurrence of such a so-called "color transition" can be reduced that a color of which the tint deviates from an ideal hue results in developing due to various factors, when the cyan, magenta and yellow inks are superimposed to express gray.

In addition, referring to FIG. 10, each discharge port array group C1, C2, M1, M2, G1, G2 excluding the yellow discharge port array group Y has three types of discharge ports through which ink droplets having different sizes are discharged, in other words, includes large discharge ports 121, medium discharge ports 122 and small discharge ports 123. Thereby, the liquid discharge head can discharge fine ink droplets, and by reducing the dot diameter on the recording medium, can form a high-resolution and high-definition image. Incidentally, the yellow discharge port array group Y is formed of only the large discharge ports 121. This is because yellow has a higher brightness and lower visibility than those of cyan and magenta, as a result, granular feeling is not conspicuous even in a low-density region, and formation of fine ink droplets is unnecessary.

Recent liquid discharge heads are strongly required to be miniaturized from the viewpoints not only of enhancing the image quality of the formed image but also of reducing the cost. However, the requirement is not sufficiently considered in the liquid discharge head having the structure described in Japanese Patent Application Laid-Open No. 2010-76394.

SUMMARY OF THE INVENTION

An object of the present invention is to provide a liquid discharge head which forms a high-definition and high-quality image while achieving miniaturization of the head.

In order to achieve the above described object, a liquid discharge head of the present invention includes: a first discharge port array group that has at least two rows of discharge port arrays arrayed in a first direction and discharges a liquid of a first color, a plurality of second discharge port array groups that each have at least two rows of discharge port arrays arrayed in the first direction and discharge a liquid of a second color, a plurality of third discharge port array groups that each have at least two rows of discharge port arrays arrayed in the first direction and discharge a liquid of a third color, and a fourth discharge port array group that has at least two rows of discharge port arrays arrayed in the first direction and discharges a liquid of a fourth color, where the first color is yellow, the second color is one of cyan and magenta, the third color is the other of cyan and magenta, and the fourth color is an intermediate color other than black, cyan, magenta and yellow, and where the third discharge port array group, the second discharge port array group, the first discharge port array group, the second discharge port array group and the third discharge port array group are arranged in this order in a second direction that intersects with the first direction. The fourth discharge port array group is arranged on one side of the first discharge port array group in the second direction, and between the first discharge port array group and the second discharge port array group. Each of the second discharge port array group and the third discharge port array group has a first discharge port array and a second discharge port array which is formed of a plurality of discharge ports having a diameter smaller than that of a plurality of discharge ports which constitute the first discharge port array. Each of discharge port arrays in the fourth discharge port array group is formed of a plurality of discharge ports having a diameter smaller than that of the plurality of discharge ports which constitute the first discharge port array.

Such a liquid discharge head arranges therein the fourth discharge port array group only on one side of the first discharge port array group, and thereby can achieve the miniaturization of the head while minimizing an influence of an air flow that is generated along with a discharge operation of the first discharge port array group.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In the present specification, the case as an example will be described below where the liquid discharge head discharges ink, but the present invention is not limited to the case, and can be applied also to a liquid discharge head which discharges another liquid.

First Embodiment

Figure 1:
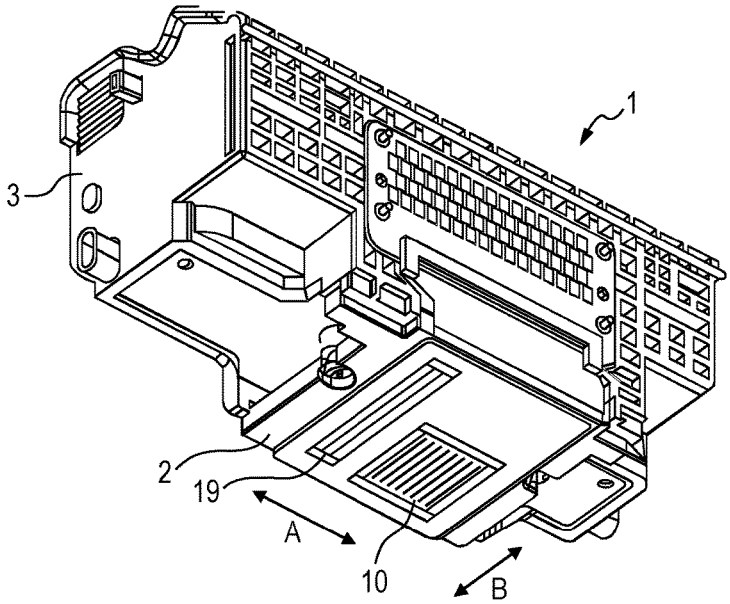
FIG. 1 is a perspective view of a liquid discharge head according to a first embodiment.

FIG. 1 is a perspective view of a liquid discharge head according to a first embodiment of the present invention.

The liquid discharge head 1 of the present embodiment is a serial type of liquid discharge head which is detachably mounted on a carriage (unillustrated) of a main body of a liquid discharge apparatus, and records an image on a recording medium that is conveyed in a sub-scanning direction B which intersects with a main scanning direction A, while reciprocating in the main scanning direction A. The liquid discharge head 1 can discharge inks of a plurality of colors from a plurality of discharge port arrays which are each arrayed in the sub-scanning direction B, and can record a color image on a recording medium, as will be described later.

The liquid discharge head 1 includes: a recording element substrate 10 (first recording element substrate) which has a plurality of discharge port arrays, and discharges the inks of the plurality of colors; a recording element substrate 19 (second recording element substrate) which discharges an ink of black; a supporting member 2 which supports the recording element substrates 10 and 19; and a housing 3 to which the supporting member 2 is joined. In the housing 3, a plurality of independent ink tanks (unillustrated) that correspond to the inks of the plurality of colors are detachably mounted, and in the inside of the housing 3, a plurality of flow channels are provided for supplying the inks from the respective ink tanks to the recording element substrate 10 and the recording element substrate 19 therethrough. Incidentally, the ink tank may be an integral type of ink tank in which a plurality of ink accommodating chambers are formed.

Figure 2:
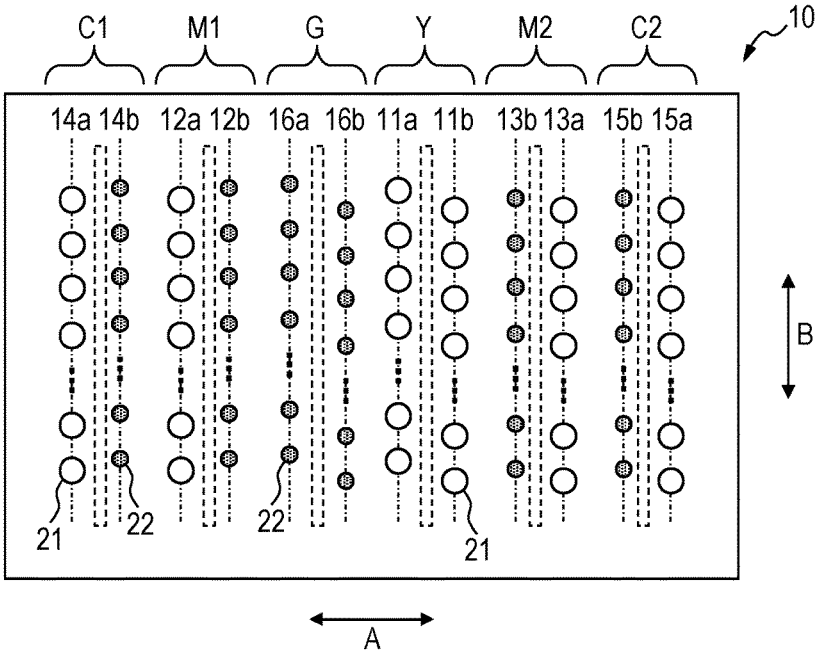
FIG. 2 is a schematic plan view of a recording element substrate according to the first embodiment.

FIG. 2 is a schematic plan view of a recording element substrate in a liquid discharge head of the present embodiment.

Referring to FIG. 2, in the recording element substrate 10, there are provided discharge port array groups of: a yellow discharge port array group (first discharge port array group) Y; two magenta discharge port array groups (second discharge port array groups) M1 and M2; and two cyan discharge port array groups (third discharge port array groups) C1 and C2. The yellow discharge port array group Y is a discharge port array group that discharges an ink of yellow (first color), and the magenta discharge port array groups M1 and M2 are discharge port array groups that discharge an ink of magenta (second color). In addition, the cyan discharge port array groups C1 and C2 are discharge port array groups that discharge an ink of cyan (third color). Each of the discharge port array groups Y, M1, M2, C1 and C2 has two rows of the discharge port arrays 11*a* to 15*b* which are arrayed in the sub-scanning direction (first direction) B.

As is illustrated in FIG. 2, these discharge port array groups Y, M1, M2, C1 and C2 are arranged in the order of the cyan discharge port array group C1, the magenta discharge port array group M1, the yellow discharge port array group Y, the magenta discharge port array group M2, and the cyan discharge port array group C2, in the main scanning direction A. In other words, the magenta discharge port array groups M1 and M2 and the cyan discharge port array groups C1 and C2 are arranged in the same order in both directions (bi-directionally) relative to the yellow discharge port array group Y as the center. Thereby, in a case where images are recorded both in a forward direction and in a backward direction in the main scanning direction A, the order of the ejection (discharge order) of the inks in each of the directions becomes the same, and the occurrence of the color unevenness due to a difference in the discharge order can be reduced.

Each of the magenta discharge port array groups M1 and M2 and the cyan discharge port array groups C1 and C2 has two types of discharge ports through which ink droplets having different sizes are discharged, in other words, is formed of large discharge ports 21 having a first diameter, and medium discharge ports 22 having a second diameter smaller than the first diameter. Specifically, discharge port arrays 12*a*, 13*a*, 14*a* and 15*a* as one in the magenta discharge port array groups M1 and M2 and the cyan discharge port array groups C1 and C2 are formed of the plurality of large discharge ports 21, and discharge port arrays 12*b*, 13*b*, 14*b* and 15*b* as the other are formed of the plurality of medium discharge ports 22.

Thus, not only the large discharge ports 21 but also the medium discharge ports 22 through which the ink droplets having a smaller size than that of the large discharge ports 21 are discharged are provided in the magenta discharge port array groups M1 and M2 and the cyan discharge port array groups C1 and C2. For this reason, the liquid discharge head can discharge fine ink droplets, and by reducing the dot diameter on the recording medium, can form a high-resolution and high-definition image.

On the other hand, both of the discharge port arrays 11*a* and 11*b* of the yellow discharge port array group Y are formed of the plurality of large discharge ports 21. This is because yellow has a higher brightness and lower visibility than those of cyan and magenta, as a result, granular feeling is not conspicuous even in a low density region, and formation of fine ink droplets is unnecessary.

Furthermore, referring to FIG. 2, in the recording element substrate 10, there is provided a gray discharge port array group (fourth discharge port array group) G which discharges an ink of gray (fourth color), in addition to the above described discharge port array groups Y, M1, M2, C1 and C2. The gray discharge port array group G also has two rows of discharge port arrays 16*a* and 16*b* which are arrayed in the sub-scanning direction (first direction) B.

In the case where various colors are expressed by superimposing inks of yellow, magenta and cyan, there is a problem that a so-called "color transition" occurs. Specifically, there is a problem that a color of which the tint deviates from an ideal hue results in developing even though the ink has been landed on an ideal position on a recording medium, in such cases that the sizes of the ink droplets are not the same, and a dye concentration in the ink deviates from an ideal designed value. In the present embodiment, the gray discharge port array group G which discharges the gray ink is provided, and accordingly it becomes unnecessary to superpose yellow, magenta and cyan inks so as to express gray. For this reason, the liquid discharge head can reduce such a defect that a color of which the tint deviates from the ideal hue results in developing due to the superimposition of inks, in other words, the occurrence of a so-called "color transition".

In addition, the gray discharge port array group G is arranged between the yellow discharge port array group Y and the magenta discharge port array group M1, in the main scanning direction A. Both of the discharge port arrays 11*a* and 11*b* of the yellow discharge port array group Y discharge ink droplets having a large size therethrough and are used with a high discharge duty. Accordingly, there is the case where a strong airflow is generated along with the discharge operation. In the present embodiment, due to the arrangement of the gray discharge port array group G, the yellow discharge port array group Y and the magenta discharge port array group M1 are arranged at a fixed space. Because of this, the above arrangement can reduce the influence of the airflow that is generated along with the discharge operation of the yellow discharge port array group Y, the influence exerted on the discharge operation of the magenta discharge port array group M1.

Figure 10:
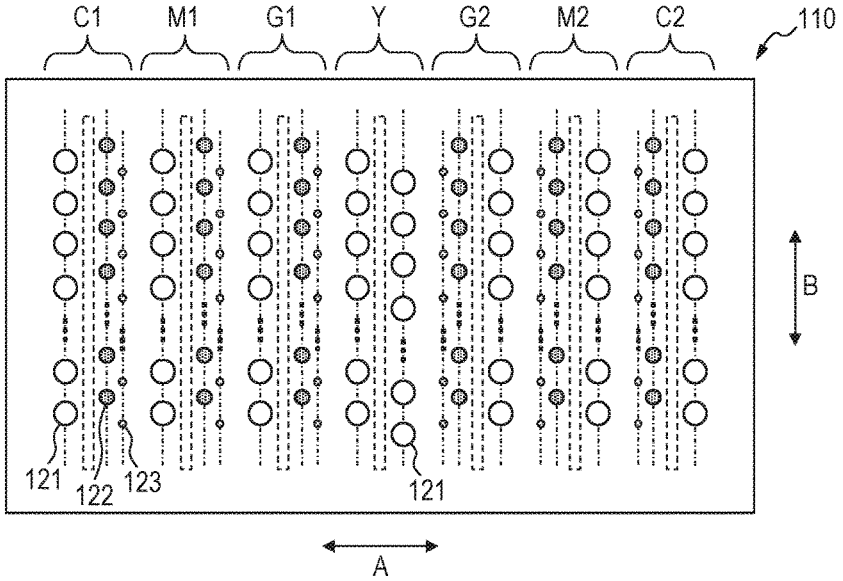
FIG. 10 is a schematic plan view of a recording element substrate in a conventional liquid discharge head.

Incidentally, the gray discharge port array group G1 is arranged not on both sides of the yellow discharge port array group Y, but on only one side thereof, in the main scanning direction A. Thereby, the liquid discharge head can achieve miniaturization of the head, compared to the configuration illustrated in FIG. 10, while minimizing the above described influence of the airflow.

The gray ink is used mainly when a high-definition photographic image is recorded, and accordingly the ink droplets to be discharged can be controlled to be as fine as possible. In addition, the photographic image is recorded in a multi-pass process, and accordingly even in the case where a photographic image having a large ink discharge amount per unit area and high density is recorded, the size itself of the ink droplet to be discharged does not need to be increased so much. Because of this, both of the discharge port arrays 16*a* and 16*b* of the gray discharge port array group G of the present embodiment are formed of medium discharge ports 22 through which ink droplets having a smaller size than that of the large discharge ports 21 are discharged. Incidentally, it is advantageous also from the viewpoint of miniaturization of the head that only the medium discharge ports 22 constitute the gray discharge port array group G.

FIG. 3 to FIG. 7 are schematic plan views illustrating several modified examples of the recording element substrate in the liquid discharge head of the present embodiment.

Figure 3:
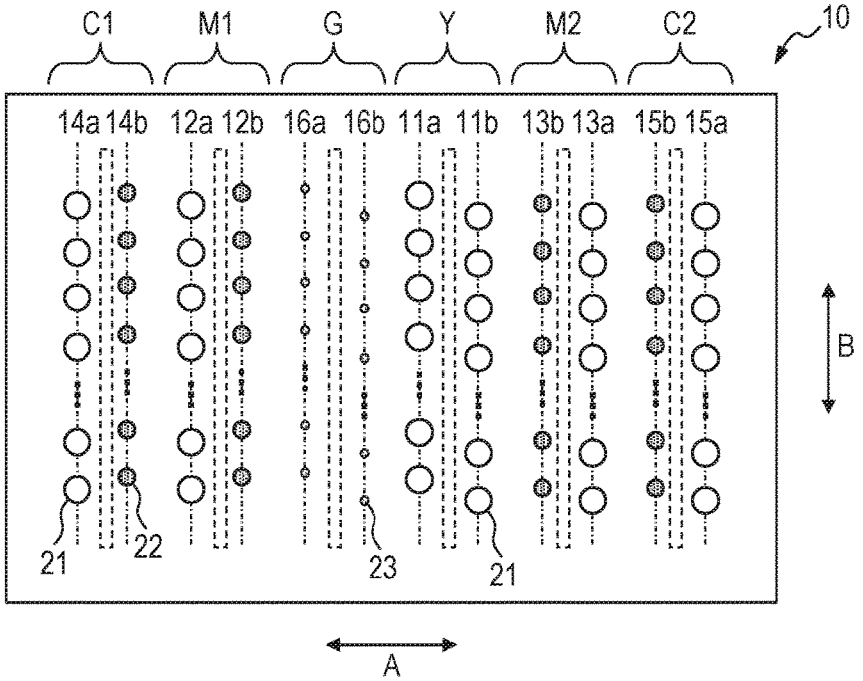
FIG. 3 is a schematic plan view illustrating a modified example of the recording element substrate according to the first embodiment.
Figure 4:
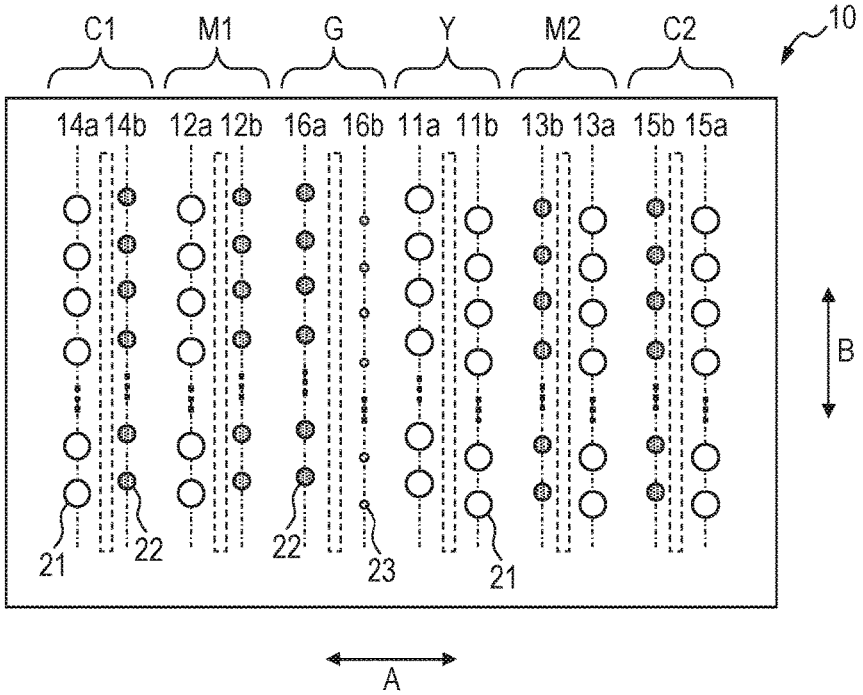
FIG. 4 is a schematic plan view illustrating a modified example of the recording element substrate according to the first embodiment.

Each of the discharge port arrays 16*a* and 16*b* in the gray discharge port array group G may be formed of discharge ports of which the diameter is smaller than that of the large discharge ports 21, as has been described above. Accordingly, both of the discharge port arrays 16*a* and 16*b* of the gray discharge port array group G may be formed of small discharge ports 23 of which the diameter (third diameter) is smaller than that of the medium discharge ports 22, as is illustrated in FIG. 3. Alternatively, as is illustrated in FIG. 4, one discharge port array 16*a* may be formed of the medium discharge ports 22, and the other discharge port array 16*b* may be formed of the small discharge ports 23.

Figure 5:
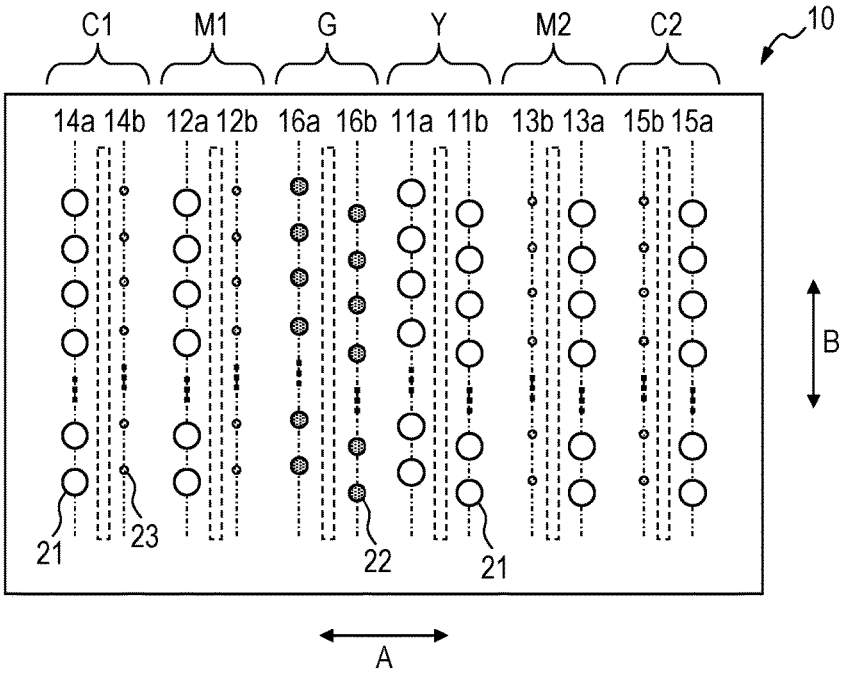
FIG. 5 is a schematic plan view illustrating a modified example of the recording element substrate according to the first embodiment.
Figure 6:
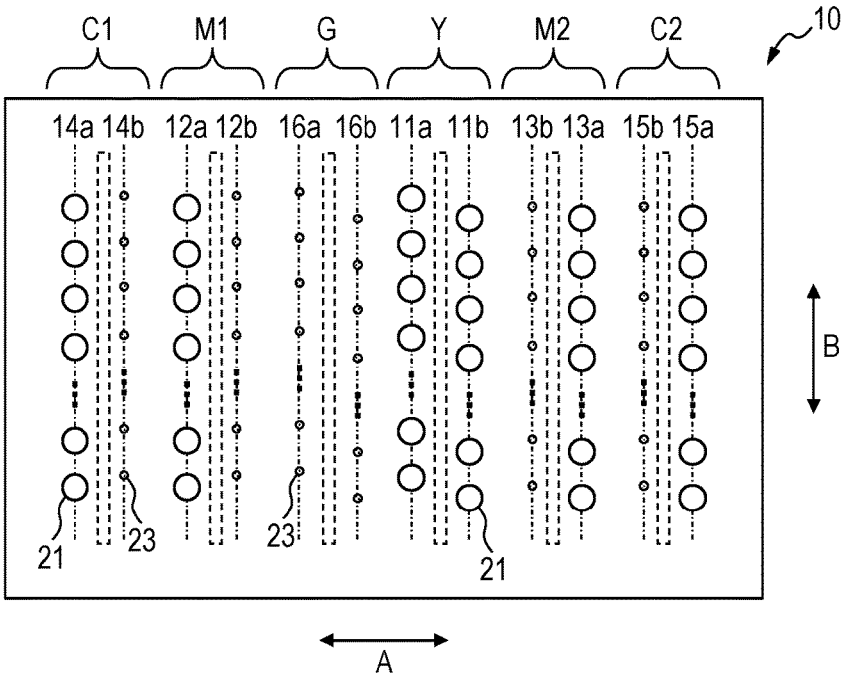
FIG. 6 is a schematic plan view illustrating a modified example of the recording element substrate according to the first embodiment.
Figure 7:
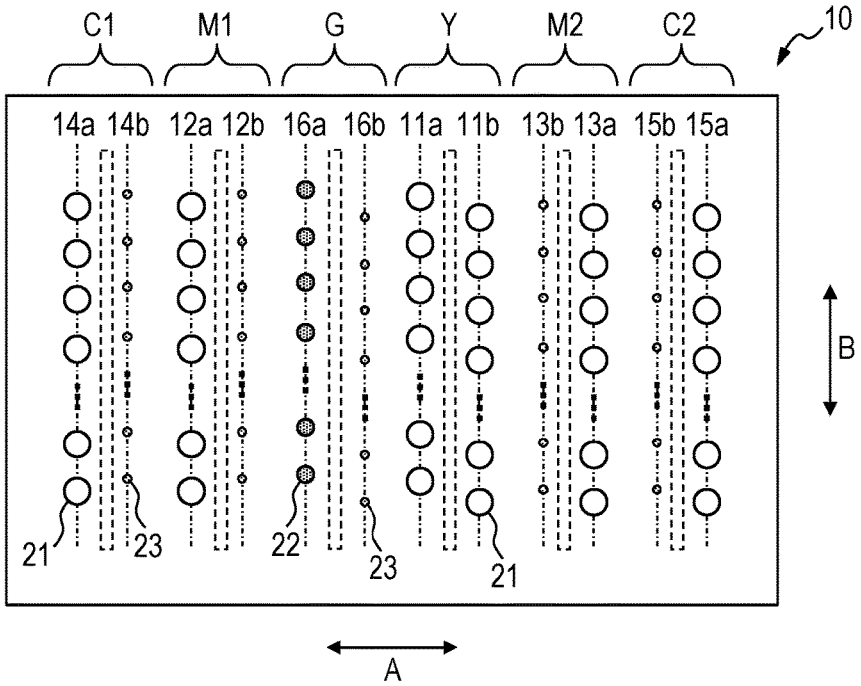
FIG. 7 is a schematic plan view illustrating a modified example of the recording element substrate according to the first embodiment.

In addition, the magenta discharge port array groups M1 and M2 and the cyan discharge port array groups C1 and C2 may be each formed of the large discharge ports 21 and the discharge ports which have the diameter smaller than that of the large discharge ports 21. Accordingly, as are illustrated in FIG. 5 to FIG. 7, the discharge port arrays 12*a*, 13*a*, 14*a* and 15*a* as one may be each formed of the large discharge ports 21, and the discharge port arrays 12*b*, 13*b*, 14*b* and 15*b* as the other are each formed of the small discharge ports 23. In this case, both of the discharge port arrays 16*a* and 16*b* of the gray discharge port array group G may be formed of the medium discharge ports 22, as is illustrated in FIG. 5; or both of the discharge port arrays 16*a* and 16*b* may be formed of the small discharge ports 23, as is illustrated in FIG. 6. Alternatively, it is also acceptable as is illustrated in FIG. 7 that one discharge port array 16*a* is formed of the medium discharge ports 22, and the other discharge port array 16*b* is formed of the small discharge ports 23.

In the above described embodiment, the magenta discharge port array groups M1 and M2 are arranged on the outside of the yellow discharge port array group Y, and the cyan discharge port array groups C1 and C2 are arranged further on the outside of the magenta discharge port array groups M1 and M2, but the arrangement of the magenta discharge port array groups M1 and M2 and the cyan discharge port array groups C1 and C2 may be reversed. Specifically, the discharge port array groups may be arranged in the order of the magenta discharge port array group M1, the cyan discharge port array group C1, the yellow discharge port array group Y, the cyan discharge port array group C2, and the magenta discharge port array group M2, in the main scanning direction A.

In addition, in the above described embodiment, the gray discharge port array group G that discharges the gray ink has been described as an example of the fourth discharge port array group which discharges the ink of the fourth color, but the ink of the fourth color may be an ink of another color. Specifically, the ink of the fourth color may be an ink of any intermediate color for enhancing the gradation of color, other than black, cyan, magenta and yellow, and may also be light cyan, light magenta, light blue, green or red, for instance.

Second Embodiment

Figure 8:
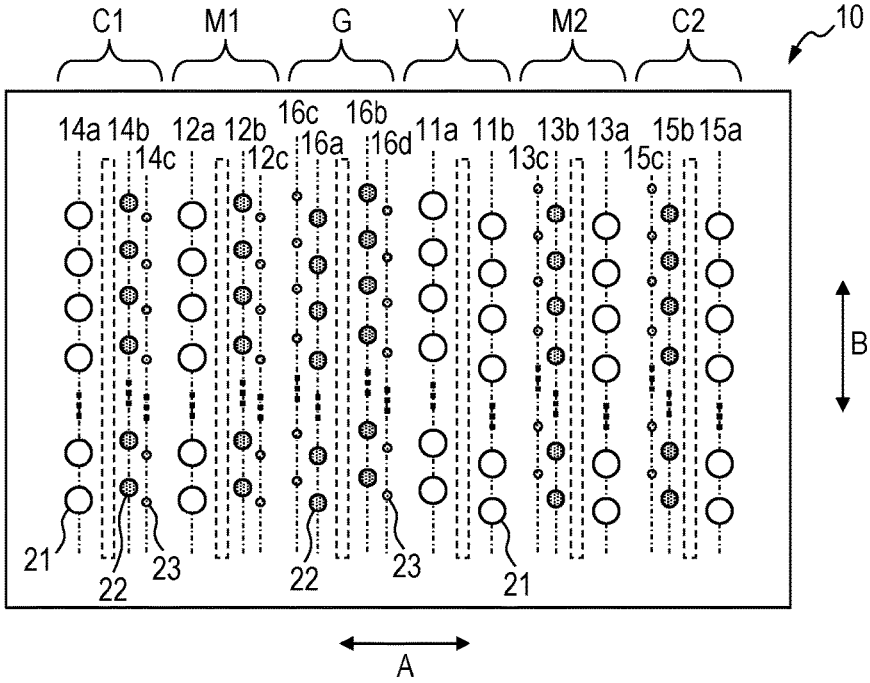
FIG. 8 is a schematic plan view of a recording element substrate according to a second embodiment.

FIG. 8 is a schematic plan view of a recording element substrate in a liquid discharge head according to a second embodiment of the present invention. Hereafter, similar structures to those in the first embodiment will be designated by the same reference numerals as those in the drawings of the first embodiment, and the description will be omitted. Only a different structure from that in the first embodiment will be described.

In the present embodiment, each of the magenta discharge port array groups M1 and M2 and the cyan discharge port array groups C1 and C2 has three types of discharge ports of which the sizes are different from one another, in other words, is formed of the large discharge ports 21, the medium discharge ports 22 and the small discharge ports 23. Specifically, the magenta discharge port array groups M1 and M2 have first discharge port arrays 12*a* and 13*a* formed of the plurality of large discharge ports 21, second discharge port arrays 12*b* and 13*b* formed of the plurality of medium discharge ports 22, and third discharge port arrays 12*c* and 13*c* formed of the plurality of small discharge ports 23, respectively. In addition, the cyan discharge port array groups C1 and C2 have first discharge port arrays 14*a* and 15*a* formed of the plurality of large discharge ports 21, second discharge port arrays 14*b* and 15*b* formed of the plurality of medium discharge ports 22, and third discharge port arrays 14*c* and 15*c* formed of the plurality of small discharge ports 23, respectively.

On the other hand, the gray discharge port array group G also has two types of discharge ports of which the sizes are different from each other, in other words, is formed of the medium discharge ports 22 and the small discharge ports 23. Specifically, in the gray discharge port array group G, the first and second discharge port arrays 16*a* and 16*b* are formed of the medium discharge ports 22, and the third and fourth discharge port arrays 16*c* and 16*d* are formed of the small discharge ports 23.

The liquid discharge head in the present embodiment has the configuration as in the above, and thereby can further enhance the gradation of color, compared to that in the first embodiment. Incidentally, also in the present embodiment, there can be various modified examples concerning the sizes of the discharge ports, similarly to those in the first embodiment.

Third Embodiment

Figure 9:
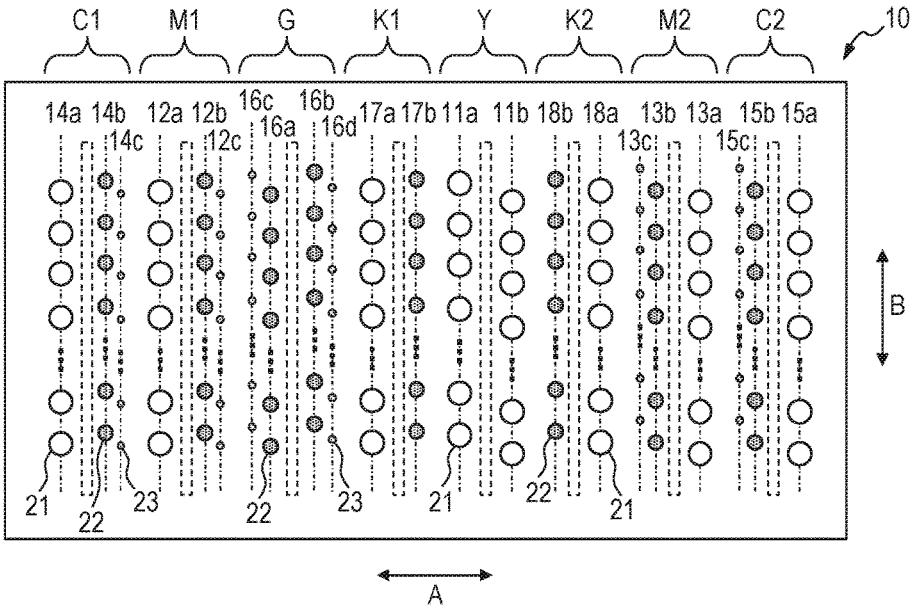
FIG. 9 is a schematic plan view of a recording element substrate according to a third embodiment.

FIG. 9 is a schematic plan view of a recording element substrate in a liquid discharge head according to a third embodiment of the present invention. Hereafter, similar structures to those in the first embodiment and the second embodiment will be designated by the same reference numerals as those in the drawings of the first embodiment and the second embodiment, and the description will be omitted. Only a different structure from those in the first embodiment and the second embodiment will be described.

The present embodiment is different from the second embodiment in the point that two black discharge port array groups (fifth discharge port array groups) K1 and K2 are additionally provided, which discharge ink of black (fifth color). Here, K1 and K2 discharge inks containing dyes of black, and the black discharge port groups that are provided in the second recording element substrate discharge inks containing black pigment. The black discharge port array groups K1 and K2 have, respectively, a pair of two rows of discharge port arrays 17*a* and 17*b*, and a pair of two rows of discharge port arrays 18*a* and 18*b*, which are arrayed in the sub-scanning direction B. One of each pair of two rows of the discharge port arrays 17*a* and 18*a* are formed of the large discharge ports 21, and the other of each pair of two rows of the discharge port arrays 17*b* and 18*b* are formed of the medium discharge ports 22.

As has been described above, both of the discharge port arrays 11*a* and 11*b* of the yellow discharge port array group Y discharge ink droplets having a large size therethrough and are used with a high discharge duty. Accordingly, there is a case where a strong airflow is generated along with the discharge operation. In the present embodiment, the black discharge port array groups K1 and K2 which are used similarly with a high discharge duty are arranged so as to be adjacent to and on both sides of the yellow discharge port array group Y, in the main scanning direction A. Thereby, the above arrangement in the present embodiment can further reduce the influence of the airflow that is generated along with the discharge operation of the yellow discharge port array group Y, the influence exerted on the discharge operation of the magenta discharge port array groups M1 and M2, compared to the first embodiment.

Incidentally, also in the present embodiment, there can be various modified examples concerning the sizes of the discharge ports, similarly to those in the first embodiment.

As has been described above, the present invention can provide a liquid discharge head which forms a high-definition and high-quality image while achieving miniaturization of the head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-101230, filed May 20, 2016, which is hereby incorporated by reference herein in its entirety.

What is claimed is:

1. A liquid discharge head comprising:

a first discharge port array group that has at least two rows of discharge port arrays arrayed in a first direction and discharges a liquid of a first color;

a plurality of second discharge port array groups that each have at least two rows of discharge port arrays arrayed in the first direction and discharge a liquid of a second color;

a plurality of third discharge port array groups that each have at least two rows of discharge port arrays arrayed in the first direction and discharge a liquid of a third color;

a fourth discharge port array group that has at least two rows of discharge port arrays arrayed in the first direction and discharges a liquid of a fourth color; and a plurality of fifth discharge port array groups that each have at least two rows of discharge port arrays arrayed in the first direction and discharge a liquid of a fifth color, wherein the first color is yellow, the second color is one of cyan and magenta, the third color is the other of cyan and magenta, the fourth color is an intermediate color other than black, cyan, magenta and yellow, and the fifth color is black, one of the third discharge port array groups, one of the second discharge port array groups, the first discharge port array group, another of the second discharge port array groups, and another of the third discharge port array groups are arranged in this order in a second direction that intersects with the first direction, the fourth discharge port array group is arranged on one side of the first discharge port array group in the second direction, and between the first discharge port array group and one of the second discharge port array groups, each of the second discharge port array groups and the third discharge port array groups has a first discharge port array and a second discharge port array which are formed of a plurality of discharge ports having a diameter smaller than that of a plurality of discharge ports which constitute the first discharge port array, each of discharge port arrays in the fourth discharge port array group is formed of a plurality of discharge ports having a diameter smaller than that of a plurality of discharge ports which constitute the first discharge port array, the fifth discharge port array groups each include a discharge port array formed of a plurality of discharge ports which have the same diameter as that of the plurality of discharge ports that constitute the first discharge port array, and a discharge port array that is formed of a plurality of discharge ports which have a diameter smaller than that of the plurality of discharge ports that constitute the first discharge port array, and the fifth discharge port array groups are arranged so as to be adjacent to the first discharge port array group on both sides of the first discharge port array group in the second direction.

2. The liquid discharge head according to claim 1, wherein each of the first discharge port arrays is formed of a plurality of discharge ports having a first diameter, each of the second discharge port arrays is formed of a plurality of discharge ports having a second diameter smaller than the first diameter, or a third diameter smaller than the second diameter, and each of the discharge port arrays in the fourth discharge port array group is formed of a plurality of discharge ports having the second diameter or the third diameter.

3. The liquid discharge head according to claim 1, wherein the first discharge port array group has two discharge port arrays, and each of the discharge port arrays of the first discharge port array group is formed of a plurality of discharge ports having the same diameter as that of the plurality of discharge ports of the first discharge port arrays.

4. The liquid discharge head according to claim 1, wherein the fourth color is gray.

5. The liquid discharge head according to claim 1, further comprising a first recording element substrate and a second recording element substrate, wherein the first to fourth discharge port array groups are provided in the first recording element substrate.

6. The liquid discharge head according to claim 5, wherein a discharge port array group which discharges black ink is provided in the second recording element substrate.

7. The liquid discharge head according to claim 1, further comprising a first recording element substrate and a second recording element substrate, wherein the fifth discharge port array group is provided in the first recording element substrate and discharges ink containing black dye, and a discharge port group which is provided in the second recording element substrate discharges ink containing black pigment.

8. The liquid discharge head according to claim 1, wherein one of the third discharge port array groups, one of the second discharge port array groups, one of the fifth discharge port array groups, the first discharge port array group, another of the fifth discharge port array groups, the fourth discharge port array group, another of the second discharge port array groups, and another of the third discharge port array groups are arranged in this order in the second direction.

* * * * *